US005738229A

United States Patent [19]

Fairweather

[11] Patent Number: 5,738,229

[45] Date of Patent: Apr. 14, 1998

[54] DISPLAY RACK

[76] Inventor: Brian Don Fairweather, 88 Kidmore End Road., Emmer Green, Reading, Berkshire RG4 8SL, United Kingdom

[21] Appl. No.: 652,013

[22] Filed: May 21, 1996

[30] Foreign Application Priority Data

May 30, 1995 [GB] United Kingdom ..... 9510869

[51] Int. Cl.[6] ..... A47F 7/00

[52] U.S. Cl. ..... 211/70.2

[58] Field of Search ..... 211/70.2, 60.1, 211/70.8, 62, 68, 70.3; D6/552, 553; D21/223

[56] References Cited

U.S. PATENT DOCUMENTS

| | | | |
|---|---|---|---|
| 350,523 | 10/1886 | Bodley | 211/70 X |
| 561,243 | 6/1896 | Temple | 211/70 X |
| 970,046 | 9/1910 | Hampton | 211/70 |
| 1,065,381 | 6/1913 | Martin | 211/70 X |
| 1,835,632 | 12/1931 | Buhrke | 211/70.2 |
| 2,070,254 | 2/1937 | Burgner | 211/70.2 |
| 2,419,175 | 4/1947 | Spohrer | 211/70.2 |
| 2,533,541 | 12/1950 | Warring | D21/223 X |
| 2,577,333 | 12/1951 | Klum et al. | 211/70.2 |
| 2,662,776 | 12/1953 | Hurst | 211/70.2 X |
| 3,315,815 | 4/1967 | Wittek | 211/70.2 |
| 3,472,389 | 10/1969 | Lowe | 211/70 |
| 3,503,518 | 3/1970 | Black | 211/70.2 |
| 3,826,378 | 7/1974 | Novak | 211/70 X |
| 4,003,612 | 1/1977 | Munsell | 312/245 |
| 4,181,167 | 1/1980 | Ret | 211/70.2 X |
| 4,450,967 | 5/1984 | Castro | 211/60.1 X |
| 4,467,925 | 8/1984 | Ratzloff et al. | 211/60 |
| 5,022,534 | 6/1991 | Briggs | 211/4 |
| 5,255,799 | 10/1993 | Haynes | 211/68 |

FOREIGN PATENT DOCUMENTS 0 063 104 A1 1/1982 European Pat. Off. .

*Primary Examiner*—Alvin C. Chin-Shue
*Assistant Examiner*—Sarah Purol
*Attorney, Agent, or Firm*—Sheridan Ross P.C.

[57] ABSTRACT

A display rack comprising a support (4) and a row of arms (5) which extend away from the support, each arm having a tip (6) which points back towards the support for hooking an elongate object such as a golf club (10) to retain it in a slot (3) between the arm and the support. The display rack is usually incorporated in a display. Elongate objects such as golf clubs may be displayed so as to extend generally vertically.

31 Claims, 3 Drawing Sheets

FIG. 2.
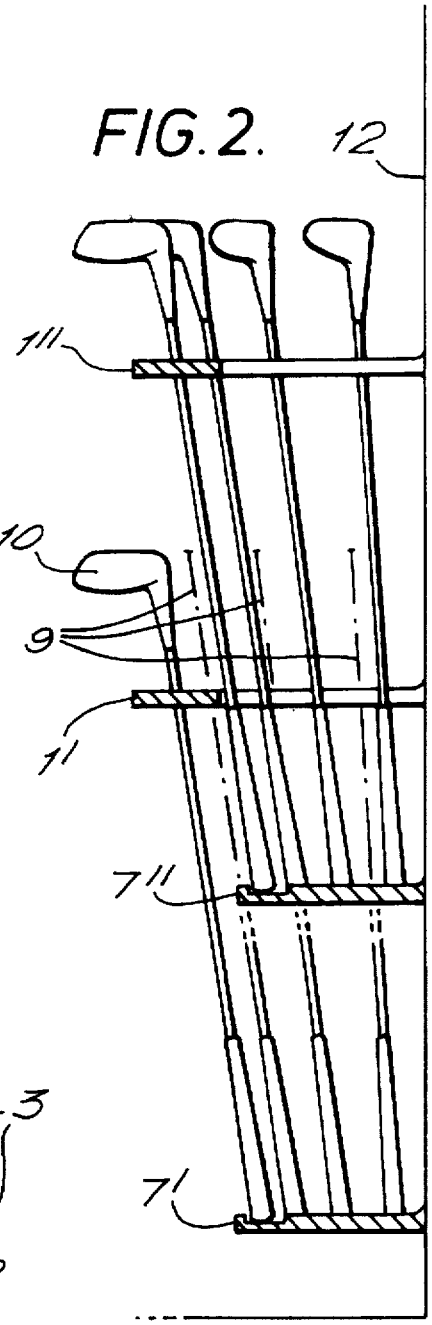
FIG. 3.
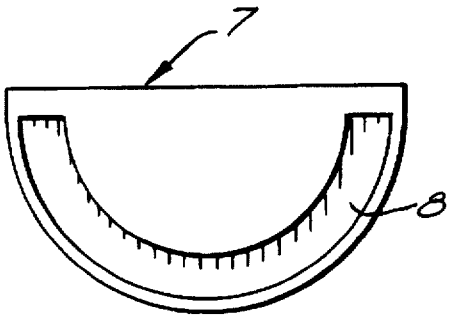
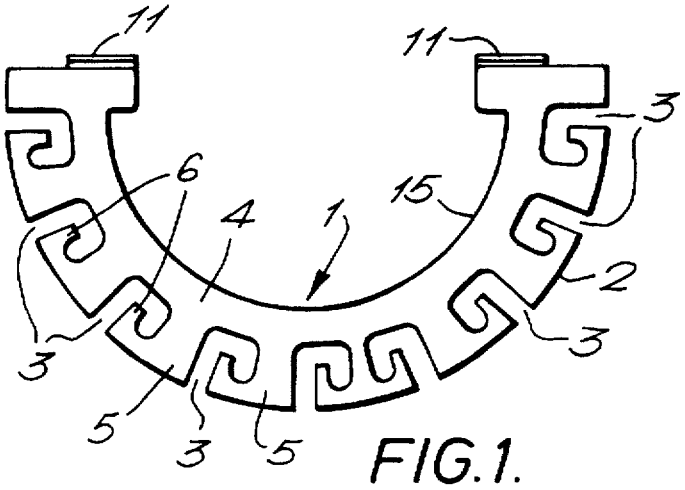
FIG. 1.

DISPLAY RACK

FIELD OF THE INVENTION

The present invention relates to a display rack suitable for displaying elongate objects such as golf clubs. The invention also relates to a display incorporating the display rack and to a plurality of displays.

BACKGROUND AND SUMMARY OF THE INVENTION

A known display rack comprises a straight support along one edge of which is positioned a straight row of arms. Each arm is straight and points away from the support so that the gaps between the arms define slots which are perpendicular to the support. In order to display golf clubs, the display rack projects generally horizontally from a wall at a position spaced above a base. The golf clubs are displayed upside down with their handles resting on the base. The shaft of each club leans into a respective one of the slots of the display rack so that the shaft rests against the support at the far end of the slot. The overall arrangement is that all of the displayed golf clubs lean away from a customer in the shop. A further disadvantage is that the heads of the golf clubs are relatively bulky and tend to be positioned close to each other, which can make the removal of a particular golf club somewhat difficult.

According to a first aspect of the present invention, there is provided a display rack comprising a support and a row of arms which extend away from the support, each arm having a tip which points back towards the support for hooking an elongate object to retain it in a slot between the arm and the support.

With the display rack, it is possible to form a display in which the elongate objects do not rest against the support but instead are held by the arms. This enables a variety of visually appealing and easy-to-use displays to be formed as will be discussed later with regard to the embodiments shown in the drawings.

Usually, the arms generally lie in a common plane so that the slots are generally coplanar with the arms.

In the preferred arrangement, the support and arms are in the form of a strip with the slots running inwards from a first side edge of the strip. If the display rack is in the form of a strip, it is easy to manufacture. Also, a plurality of display racks may be cut from a single sheet of material, such as a wooden board.

Preferably, the strip has a second side edge which is substantially parallel to the first side edge. The second side edge may include a row of recesses in order to increase the display capacity of the display rack.

The first side edge may be straight. Preferably, however, the first side edge is convex. For example, the first side edge may comprise at least part of the circumference of a circle, e.g. substantially a quarter, half or the full circumference of a circle.

According to a second aspect of the present invention, there is provided a display comprising a base and a display rack supported above the base, the display rack being in accordance with the first aspect of the present invention and positioned relative to the base so as to define a plurality of notional display axes each extending upwards from the base and extending through a respective one of the slots of the display rack.

Preferably, if the first side edge of the display rack is convex, the notional display axes are arranged to lie on a notional downwardly-tapering generally cone-like surface. When the elongate objects are items such as golf clubs and are positioned along the notional display axes, the set of displayed golf clubs splays apart in the upward direction so that the heads of the golf clubs are positioned further apart than the handles of the golf clubs which are resting on the base of the display. This produces an attractive appearance and makes it easy to remove a particular golf club.

In order to make it clear to the person inserting the elongate objects in the display as to where the lower ends of the elongate objects should be located on the base, it is preferable that the base includes a row of recessed locations for the bottom ends of the notional display axes. Thus, the user may simply position the lower ends of the elongate objects in the recessed locations.

In a particularly preferable arrangement, the row of recessed locations is curved and has a tighter radius of curvature than the convex first side edge of the display rack. This helps to ensure that the person incorporating the elongate objects in the display will produce the desired splaying apart of the displayed elongate objects.

The recessed locations of the row may merge into each other and be provided by an elongate recess. Alternatively, the base may have a row of discrete recesses each of which defines a respective one or group of the row of recessed locations.

According to a third aspect of the present invention, there is provided a plurality of displays, each display being in accordance with the second aspect of the present invention, wherein a communal stand supports all of the display racks above their respective bases.

Thus, displays may be added in modular manner to the collection of displays to produce an overall collection which is big enough to be suited to the required use.

When each display rack is such that the support and arms of the display rack are in the form of a strip with the slots running inwards from a first side edge of the strip, it is possible to arrange the plurality of displays so that the strips of the display racks are disposed along a serpentine path. Preferably, along the direction of the serpentine path, successive first side edges of the strips face alternately in opposite directions. When the elongate objects such as golf clubs are incorporated in the plurality of displays, the golf clubs may be positioned so as to appear to resemble a serpentine wave of golf clubs.

According to a fourth aspect of the present invention, there is provided a plurality of displays, each display being in accordance with the second aspect of the present invention, wherein a first one of the displays is positioned higher than a second one of the displays. This produces a compact arrangement in which a large number of elongate objects such as golf clubs may be displayed.

Usually, the base of the first display is higher than the base of the second display but lower than the display rack of the second display.

If desired, one or more further displays may be stacked above the first display.

The common stacking axis of the displays may be generally vertical or may lean away from the customer. Alternatively or additionally, the common stacking axis may be tilted to one side when viewed from the front by the customer.

The present invention also includes a display or plurality of displays in which a plurality of elongate objects (e.g. golf clubs) are actually positioned along respective ones of the notional display axes so as to be hooked in position by the arms of the display rack(s).

BRIEF DESCRIPTION OF THE DRAWINGS

Non-limiting embodiments of the present invention will now be described with reference to the accompanying drawings, in which:

FIG. 1 is a plan view of a display rack in accordance with the present invention;

FIG. 2 is a side view of a plurality of displays in accordance with the present invention;

FIG. 3 is a plan view of a base incorporated in the plurality of displays of FIG. 2;

DETAILED DESCRIPTION OF PREFERRED EMBODIMENTS

Figure 5:
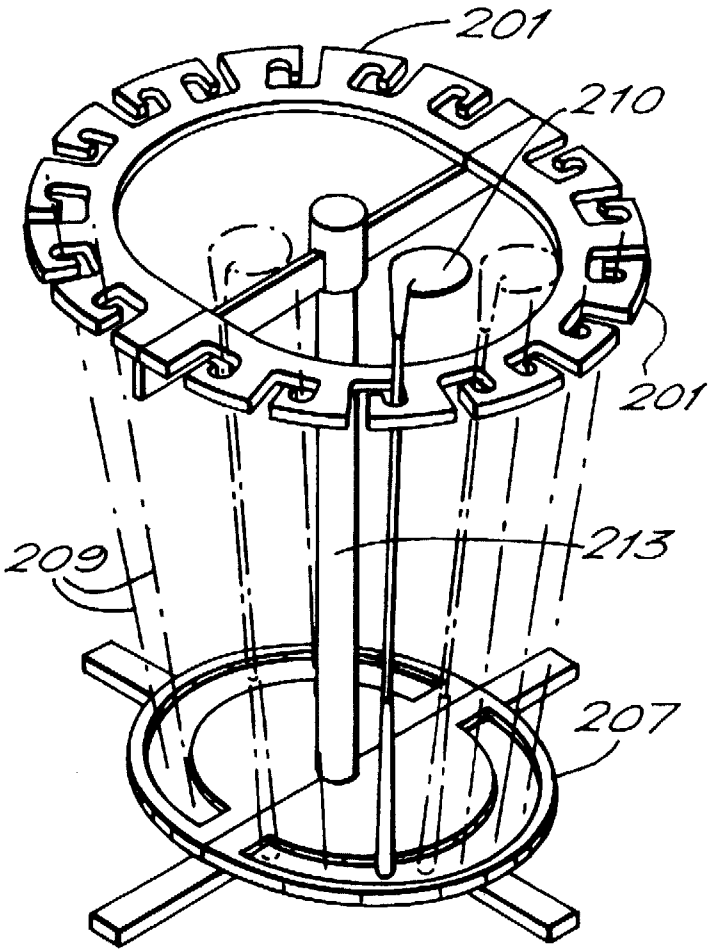
FIG. 5 is a perspective view of another display in accordance with the present invention.

Referring to FIG. 1, the display rack 1 is in the form of a curved flat strip that may be cut out of a sheet of material such as wood or may be injection moulded out of plastics material. The strip has a first, radially outer side edge 2. A plurality of generally J-shaped slots 3 run inwards from the first side edge 2. If the display rack is being cut out of a sheet of material, the machine which cuts out the general outline of the display rack may also be used to cut out the individual slots 3. The overall appearance of the display rack 1 is such that it has an elongate support 4 which runs the length of the display rack and a plurality of arms 5 which extend away from the support 4. Each arm 5 has a tip 6 which points back towards the support 4. This enables the arm to hook an elongate object to retain it in the associated slot 3 that is present between the arm 5 and an adjacent one of the arms. As viewed in FIG. 1, the elongate objects such as golf clubs would project up out of the plane of the paper and would lean radially outwards against the arms 5 at the closed ends of the slots 3.

Each slot 3 is illustrated as being generally J-shaped, but instead it could, for example, be generally T-shaped with the stem of the T running inwards from the first side edge 2 and the top part of the T being bent at each end back towards the edge 2. Thus, a pair of the arms 5 would define the slot. The display rack 1 could combine J-shaped and T-shaped slots.

In FIG. 2, the plurality of displays comprises a first display (display rack 1' and display base 7') which is stacked beneath a second display (display rack 1" and display base 7").

The display base 7 is illustrated in more detail in FIG. 3. As may be seen, the display base 7 is in the form of a platform which incorporates, in its upper surface, an elongate recess for receiving the bottom ends of the golf clubs. The elongate recess 8 defines a series of recessed locations for the bottom ends of the golf clubs. It may be seen that the radius of curvature of the recess 8 is tighter than the radius of curvature of the first side edge 2 of the display rack 1. As a result, each of the displays illustrated in FIG. 2 is such that the notional display axes 9 which extend upwards from the recess 8 so as to pass through respective ones of the slob 3 of the display rack 1 appear to lie on a notional downwardly-tapering generally cone-like surface.

Some of the notional display axes 9 are illustrated in FIG. 2. As a result of this outward splaying of the notional display axes 9, golf clubs 10, when aligned along respective ones of the display axes 9, splay apart from one another in the upward direction so that the heads of the golf clubs are spaced further apart from one another than the handles of the golf clubs. This produces a compact display of the golf clubs while still ensuring that the heads of the golf clubs do not clash with one another so as to make removal of a particular golf club difficult.

As is apparent from FIG. 2, the display base 7" of the second display is positioned below the display rack 1' of the first display. This helps to ensure that the plurality of displays are reasonably compact.

In the arrangement illustrated in FIG. 2, clips 11 (see FIG. 1) at the ends of the strip of each display rack 1 are used to clip the display rack to a support surface 12 of a wall. Instead of the support surface 12 being provided by a wall, it could instead be provided by a stand capable of being located, for example, in the middle of a room.

The display rack 1 illustrated in FIG. 1 is generally semi-circular. In a smaller version of the display rack, the length would be cut in half to be approximately a quadrant or a quarter of a circle. Under these circumstances, it would only be necessary to provide a single clip 11 so that one end of the display rack would be attached to the support surface 12 but the other end of the display rack would be freely projecting away from the support surface.

A series of recesses (not shown) may be provided in a second side edge 15 of the display rack 1 so as to permit a second row of golf clubs to be leaned against the support 4 at a position radially inwards of the row of golf clubs hooked by the arms 5. Both rows would have the handles of the golf clubs resting on the same base 7.

Figure 4:
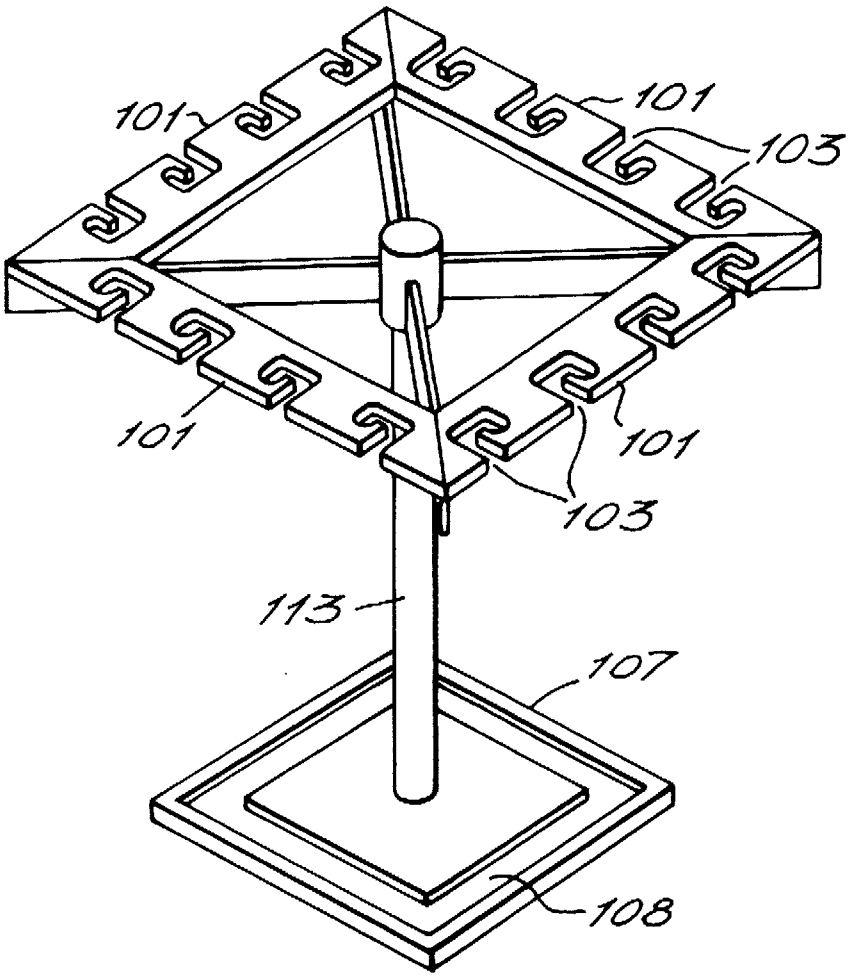
FIG. 4 is a perspective view of a display in accordance with the present invention.

FIG. 4 is a perspective view of a display. It includes four display racks 101. Each display rack 101 is in the form of a flat strip with generally straight and parallel side edges. As a result, the slots 103 are arranged in a straight line. The four display racks 101 are joined end to end to form an overall square-like display rack. The display racks 101 are supported by a stand 113 above a communal square base 107 which incorporates a square recess 108. The size of the recess 108 is smaller than the square formed by the four display racks 101. As a result, when golf clubs (not shown) are stood upside down in the recess 108, they may be hooked by the arms 103 so that they all lean outwards away from the stand 113.

FIG. 5 shows a different display. Two display racks 201 of the general type illustrated in FIG. 1 are joined end to end to form an annular, approximately circular display rack which is supported by a stand 213 above a base 207. The base 207 is formed by joining together two of the bases 7 of the type illustrated in FIG. 3. Some of the notional display axes 209 are illustrated in FIG. 5 and it may be seen that they appear to lie on the surface of a downwardly-tapering cone. As a result, the golf clubs 210 positioned along the display axes 209 are splayed apart from one another in the upward direction.

Figure 6:
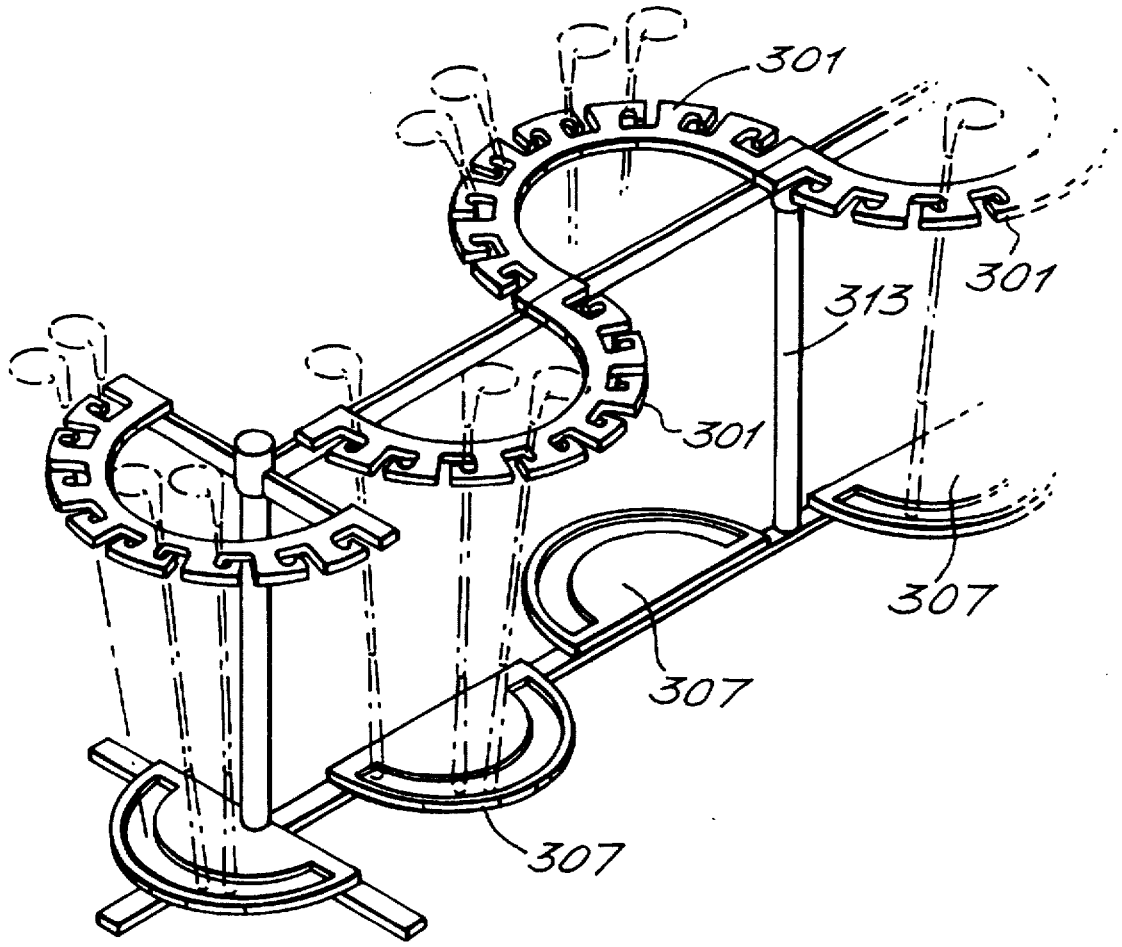
FIG. 6 is a perspective view of a serpentine plurality of displays in accordance with the present invention.

FIG. 6 illustrates a plurality of displays in which a plurality of display racks 301 of the general type illustrated in FIG. 1 are connected end to end so as to form a serpentine arrangement. It may be seen that the slots of successive display racks switch from one side of the serpentine path to the other side and then back again. Respective bases 307 of the general type illustrated in FIG. 3 are positioned beneath the display racks 301. An elongate stand 313 maintains the desired positioning of the display racks 301 above their bases 307.

While various embodiments of the present invention have been described in detail, it is apparent that modifications and adaptations of those embodiments will occur to those skilled in the art. It is to be expressly understood, however, that such modifications and adaptations are within the scope of the present invention, as set forth in the following claims.

What is claimed is:

1. A display comprising:

a base and a display rack supported above the base;

the display rack comprising a support and a row of arms which extend in respective forward directions away from the support, each arm having a tip which points back towards the support for hooking an elongate object to retain it in a slot between the arm and the support; and the display rack being positioned relative to the base so as to define a plurality of notional display axes for the elongate objects, each notional display axis extending upwards from the base and extending upwards and forwards through a respective one of the slots of the display rack.

2. A display according to claim 1, wherein the arms generally lie in a common plane so that the slots are generally coplanar with the arms.

3. A display according to claim 1, wherein the support and arms are in the form of a strip with the slots running inwards from a first side edge of the strip.

4. A display according to claim 3, wherein the strip has a second side edge which is substantially parallel to the first side edge.

5. A display according to claim 3, wherein the first side edge is straight.

6. A display according to claim 3, wherein the first side edge is convex.

7. A display according to claim 3, wherein the first side edge comprises at least part of the circumference of a circle.

8. A display according to claim 7, wherein the first side edge comprises substantially half of the circumference of a circle.

9. A display according to claim 7, wherein the first side edge comprises substantially the full circumference of a circle.

10. A display according to claim 1, wherein the display rack is mounted on a wall.

11. A display according to claim 1, wherein the display rack is mounted on a stand.

12. A display according to claim 1, wherein the support and arms are in the form of a strip with the slots running inwards from a first, convex side edge of the strip and the notional display axes lie on a notional downwardly-tapering generally cone-like surface.

13. A display according to claim 12, wherein the base includes a row of recessed locations for the bottom ends of the notional display axes.

14. A display according to claim 13, wherein the row of recessed locations is curved and has a tighter radius of curvature than the convex first side edge of the display rack.

15. A display according to claim 13, wherein the base has an elongate recess which defines the row of recessed locations.

16. A display according to claim 13, wherein the base has a row of discrete recesses each of which defines a respective one or group of the row of recessed locations.

17. A plurality of displays, wherein:

each display comprises:

a base and a display rack supported above the base;

the display rack comprising a support and a row of arms which extend away from the support, each arm having a tip which points back towards the support for hooking an elongate object to retain it in a slot between the arm and the support; and the display rack being positioned relative to the base so as to define a plurality of notional display axes each extending upwards from the base and extending through a respective one of the slots of the display rack; and a communal stand supports all of the display racks above their respective bases.

18. A plurality of displays according to claim 17, further comprising a plurality of elongate objects positioned in the places of the notional display axes.

19. A plurality of displays, wherein each display comprises:

a base and a display rack supported above the base;

the display rack comprising a support and a row of arms which extend away from the support, each arm having a tip which points back towards the support for hooking an elongate object to retain it in a slot between the arm and the support; and the display rack being positioned relative to the base so as to define a plurality of notional display axes each extending upwards from the base and extending through a respective one of the slots of the display rack; and a communal stand supports all of the display racks above their respective bases, wherein each display rack is such that its support and arms are in the form of a strip with the slots running inwards from a first edge of the strip, and the strips of the display racks are disposed along a serpentine path.

20. A plurality of displays, wherein each display comprises:

a base and a display rack supported above the base;

the display rack comprising a support and a row of arms which extend away from the support, each arm having a tip which points back towards the support for hooking an elongate object to retain it in a slot between the arm and the support; and the display rack being positioned relative to the base so as to define a plurality of notional display axes each extending upwards from the base and extending through a respective one of the slots of the display rack; and a communal stand supports all of the display racks above their respective bases, wherein each display rack is such that its support and arms are in the form of a strip with the slots running inwards from a first edge of the strip, and the strips of the display racks are disposed along a serpentine path and, wherein along the direction of the serpentine path successive first side edges of the strips face alternately in opposite directions.

21. A plurality of displays, wherein:

each display comprises:

a base and a display rack supported above the base;

the display rack comprising a support and a row of arms which extend away from the support, each arm having a tip which points back towards the support for hooking an elongate object to retain it in a slot between the arm and the support; and the display rack being positioned relative to the base so as to define a plurality of notional display axes each extending upwards from the base and extending through a respective one of the slots of the display rack; and a first one of the displays is positioned higher than a second one of the displays.

22. A plurality of displays according to claim 21, wherein the base of the first display is higher than the base of the second display but lower than the display rack of the second display.

23. A plurality of displays according to claim 21, wherein:

each display is such that (i) its support and arms are in the form of a strip with the slots running inwards from a first, convex side edge of the strip and (ii) its notional display axes lie on a notional downwardly-tapering generally cone-like surface; and the notional downwardly-tapering generally cone-like surfaces of the displays lie along a common stacking axis.

24. A plurality of displays according to claim 23, wherein the common stacking axis is generally vertical.

25. A display according to claim 1, further comprising a plurality of elongate objects positioned in the places of the notional display axes.

26. A display comprising:

a base and a display rack supported above the base;

the display rack comprising a support and a row of arms which extend away from the support, each arm having a tip which points back towards the support for hooking an elongate object to retain it in a slot between the arm and the support; and the display rack being positioned relative to the base so as to define a plurality of notional display axes each extending upwards from the base and extending through a respective one of the slots of the display rack, said display further comprising a plurality of elongate objects positioned in the places of the notional display axes, said elongate objects comprising golf clubs.

27. A plurality of displays, wherein each display comprises:

a base and a display rack supported above the base;

the display rack comprising a support and a row of arms which extend away from the support, each arm having a tip which points back towards the support for hooking an elongate object to retain it in a slot between the arm and the support; and the display rack being positioned relative to the base so as to define a plurality of notional display axes each extending upwards from the base and extending through a respective one of the slots of the display rack; and a communal stand supports all of the display racks above their respective bases, said displays further comprising a plurality of elongate objects positioned in the places of the notional display axes, said elongate objects comprising golf clubs.

28. A plurality of displays according to claim 21, further comprising a plurality of elongate objects positioned in the places of the notional display axes.

29. A plurality of displays according to claim 28, wherein the elongate objects are golf clubs.

30. A plurality of displays, wherein each display comprises:

a base and a display rack supported above the base;

said display rack comprising a support and a row of arms which extend away from the support, each arm having a tip which points back towards the support for hooking an elongate object to retain it in a slot between the arm and the support, said display rack being positioned relative to the base so as to define a plurality of notional display axes each extending upwards from the base and extending through a respective one of the slots of the display rack; and a communal stand supporting all of said display racks above their respective bases, said support and said arms being in the form of a strip having a first side edge with said slots running inwards from said first side edge.

31. A display comprising:

a base and a display rack supported above the base; and a plurality of golf clubs each having a shaft connecting a handle to a head;

the display rack comprising a support and a row of arms which extend in respective forward directions away from the support, each arm having a tip which points back towards the support to define a slot between the arm and the support;

the handles of the golf clubs being positioned resting on the base; and the display rack being positioned relative to the base so that the golf clubs are positioned on respective display axes each extending upwards from the base and extending upwards and forwards through a respective one of the slots of the display rack, with the golf clubs leaning forwards with their shafts hooked by the arms of the display rack and their heads positioned above the display rack.

* * * * *